United States Patent [19]

Tobler

[11] Patent Number: 4,884,846

[45] Date of Patent: Dec. 5, 1989

[54] ARM CHAIR, PARTICULARLY OFFICE ARM CHAIR, WITH ADJUSTABLE ARM RESTS

[75] Inventor: Peter Tobler, St. Margrethen, Switzerland

[73] Assignee: Equus Marketing Corp., Wald, Switzerland

[21] Appl. No.: 242,033

[22] Filed: Sep. 8, 1988

[30] Foreign Application Priority Data

Sep. 14, 1987 [CH] Switzerland ..... 3534/87

[51] Int. Cl.[4] ..... A47C 7/54

[52] U.S. Cl. ..... 297/411; 297/414

[58] Field of Search ..... 297/411, 414, 415, 420, 297/421

[56] References Cited

U.S. PATENT DOCUMENTS

| | | | |
|---|---|---|---|
| 1,400,717 | 12/1921 | Benson et al. | 297/457 |
| 2,139,028 | 12/1938 | Mensendicck et al. | 297/411 X |
| 2,647,560 | 8/1953 | Huebener | 297/411 X |
| 2,667,913 | 2/1954 | Dastin | 297/414 X |
| 2,689,600 | 9/1954 | Van Bresen | 297/415 |
| 3,100,624 | 8/1963 | Spiselman | 248/406.1 X |
| 3,386,697 | 6/1968 | Helms | 248/406.1 |
| 4,159,148 | 6/1979 | Schulz | 297/411 X |
| 4,277,102 | 7/1981 | Aaras et al. | 297/411 |

FOREIGN PATENT DOCUMENTS

| | | | |
|---|---|---|---|
| 145627 | 7/1902 | Fed. Rep. of Germany | 297/414 |
| 2020673 | 11/1971 | Fed. Rep. of Germany . | |
| 1083969 | 1/1955 | France | 297/421 |
| 2068719 | 8/1981 | United Kingdom | 297/411 |

*Primary Examiner*—Peter R. Brown

*Attorney, Agent, or Firm*—Frishauf, Holtz, Goodman & Woodward

[57] ABSTRACT

To improve seating comfort of chair users of different anatomical build, the arm rests are height-adjustable with respect to the seat by coupling the arm rests with length-adjustable support rods (21) located adjacent the seat back. To match the chair to various shoulder configurations, the arm rests can be moved inwardly and outwardly with respect to a center line of the chair as well.

6 Claims, 3 Drawing Sheets

ARM CHAIR, PARTICULARLY OFFICE ARM CHAIR, WITH ADJUSTABLE ARM RESTS

The present invention relates to home and office arm chairs, and more particularly to arm chairs which are used for extended periods of time and thus should provide comfortable seating to users of different heights and limb configurations.

BACKGROUND

The design of chairs, and particularly of office chairs, has been given attention in recent years; so-called "ergonometric" models were provided in which great effort has been expended to match the seat configuration to the human anatomy of users. Specific attention has been given to adjustability of the seat and the back rest, synchronization of movement of seat and back seat, and relative change of adjustment between seat and back rest.

Chairs, and especially office chairs, are increasingly used for extended periods of time. Chairs are sold essentially only in "one size fits all" configurations, based essentially on their intended use. No attention has been given to the design of the chair itself with respect to matching the configuration of the chair to the anatomy, size, and limb configuration of the users. Even automobile seats are adjustable only with respect to operating controls of the vehicle; a few permit adjustment of lumbar supports; the overall size and configuration of the chair, however, is invarying for all users, tall or short.

It is an object of the present invention to improve arm chairs, particularly office chairs, so that the comfort of the user is enhanced.

Briefly, the arm rests are constructed to be height-adjustable with respect to the seat of the chair. The arm rests are pivotably connected to the chair seat or chair seat support structure adjacent to or close to the forward edge of the seat, and supported, height-adjustably, in a region adjacent the chair back.

The invention is based on the realization that chairs should be useful for persons of widely differing sizes and widely differing relationships of trunk size to limbs; thus, the chair should be equally comfortable for persons with short trunks and long arms as for persons with long trunks and short arms. Experiments have shown that proper relationship of the arm rest of a chair is of substantial importance for the comfort of the user. Surprisingly, it has been found that already slight difference in the level of arm rests with respect to the chair seat are of substantial importance for the user's comfort and seating satisfaction. If the arm rests are too low with respect to the shoulder position of the user, which would occur if a user has a long trunk and short upper arm bone structure, the user has a tendency to lean, leading to poor posture when seated, and, over an extended period of time, to damage due to the poor posture. If the arm rests are too high with respect to the shoulder position of the user, the user has the tendency not to use the arm rest at all or, again, to tilt upwardly in the seat against the arm rests which interferes with seating comfort. When the arms rests have the appropriate height, they are used more, and properly, by the seated person. Periodic raising by bracing against the arm rests leads to periodic unloading of the spinal column which, surprisingly, substantially improves the seating satisfaction of the user. The user is much less subject to tiredness, cramps in back muscles, back pain, and the like, if the height of the arm rest is matched to the anatomical configuration of the user.

In accordance with a preferred embodiment of the invention, the respective arm rests are supported by support elements which are adjustable in their length. This permits a simple construction of pleasing appearance. Changing the length of the support element can be simple by constructing the support element with a thread which engages with a thread of the carrier or in an adjustment nut. Simple height adjustment by merely rotating the carrier element or the adjustment nut, respectively, is thus possible. In accordance with a preferred feature of the invention, the support element is a two-part bolt structure, each bolt structure carrying, respectively, a right-hand thread and a left-hand thread, coupled together by an adjustment nut with matching threads. This arrangement permits rapid adjustment of the height of the support element and doubling of the possible height adjustment for a given rotation of the adjustment nut. Preferably, the adjustment nut is an elongated sleeve fitting over the threaded portions of the bolt elements which is readily accessible for rotation. The sleeve covers the threaded portions of the bolt elements, which is desirable from an appearance point of view and prevents contamination of the thread elements, or casual contact therewith by the user.

In accordance with a further preferred feature of the invention, a stop arrangement, for example a snap ring or the like, is located within the adjustment nut or sleeve to limit the height adjustment and prevent excessive rotation of the adjustment nut or sleeve by a careless user, thereby releasing the threaded support elements or bolt elements from the adjustment nut. A scale can be located on one of the bolt elements so that a desired position can readily be obtained again after adjustment, for example by a different user. This scale can indicate the degree of adjustment or of respective positions.

In accordance with a preferred feature of the invention, the arm rests are bent downwardly adjacent the forward edge of the seat and pivotably connected to the seat or its support structure by laterally adjustable carrier or support elements. The rearward portion of the arm rests are secured to upwardly extending support rods, adjustable as described above, which, in turn, are pivotably connected near the chair back or adjacent thereto to the seat or the seat support structure. This results in a simple construction of pleasing appearance. By pivotably connecting the support elements for the arm rests and the arm rests themselves, respectively, adjacent the rear and forward portion of the seat, pivot connections can be used which, preferably, can be laterally adjusted with respect to the seat so that users of narrow shoulder width can move the arm rests close towards the seat, whereas users with wide shoulders can spread the arm rests out by increasing the horizontal spacing between the arm rests, so that they are universally adjustable, both with respect to height as well as spacing in relation to the seat, and hence to the anatomy of the user.

Bending the arm rests to merge at their forward sides close to the seat not only provides for pleasing appearance of the chair but additionally permits fitting the chair beneath furniture, such as tables or desks, without impinging on desk drawers or other structural elements of other furniture components.

Drawings, illustrating embodiments of the invention:

DETAILED DESCRIPTION

Figure 1:
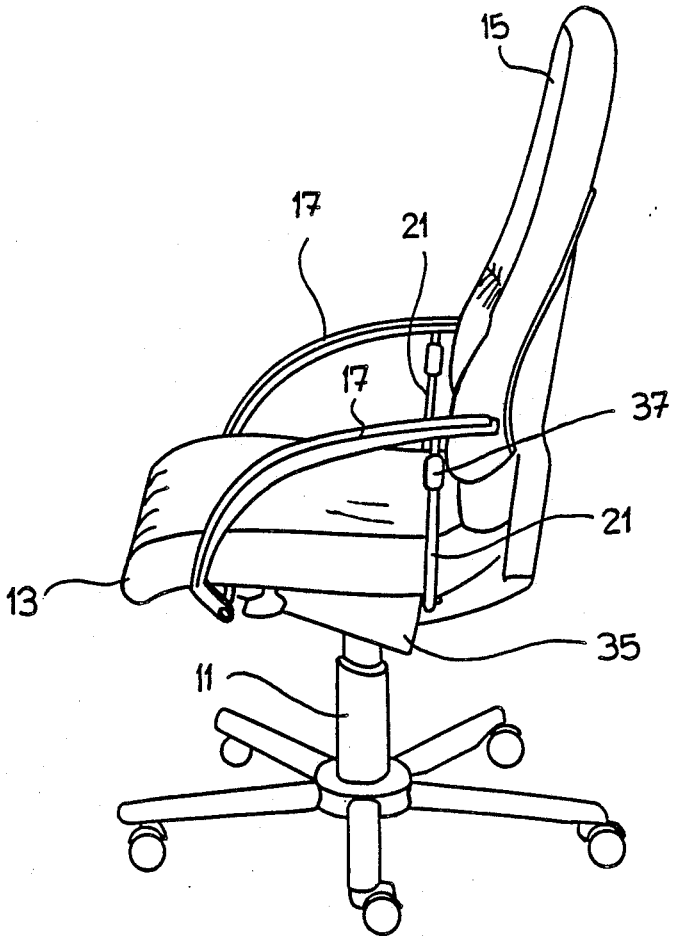
FIG. 1 is a perspective view of an office chair with height-adjustable arm rests.

The chair shown in FIG. 1 is illustrated as an office chair which has a customary support spider 11, a seat 13, a back rest 15 and arm rests 17.

In accordance with the present invention, the level of the arm rests 17, in the region where they are usually engaged by a user, is height adjustable.

Figure 2A:
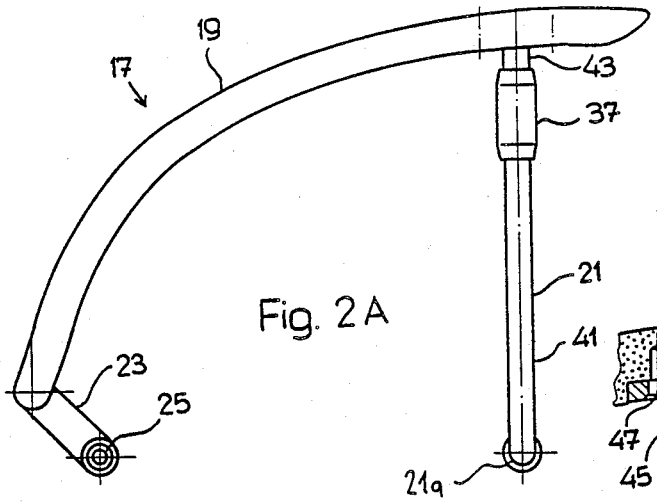
FIG. 2A is a side view of an arm rest, and its upright support.
Figure 2B:
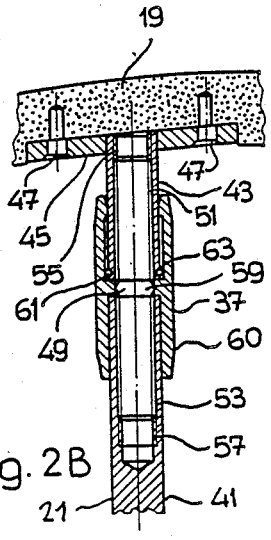
FIG. 2B is an enlarged sectional view of the support.
Figure 3:
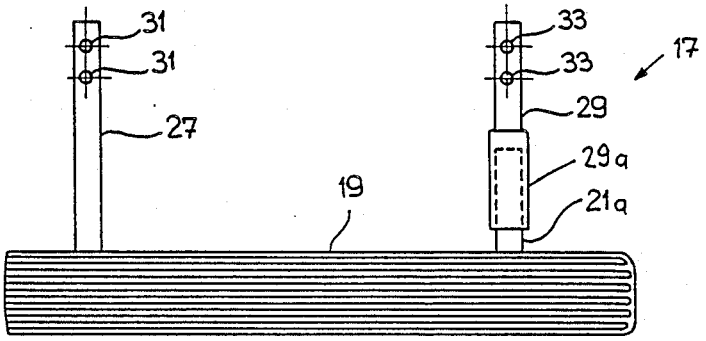
FIG. 3 is a top view of the arm rest of FIG. 2A, and showing its lateral supports.
Figure 4:
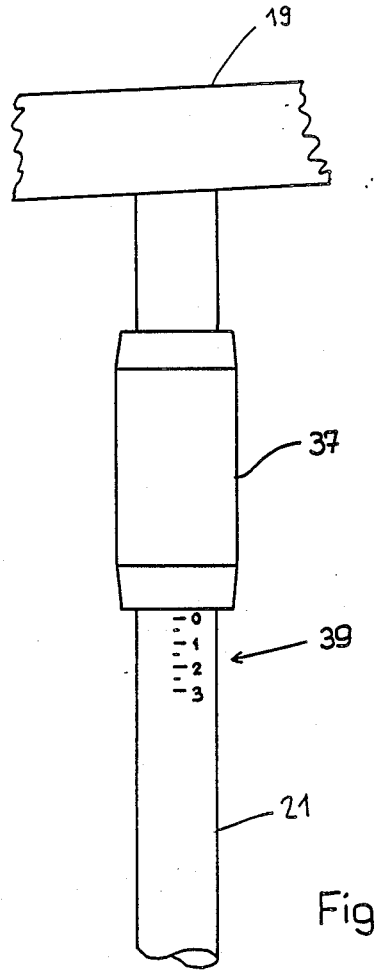
FIG. 4 is an enlarged side view of the arm rest and its upright support and illustrating a positioning scale and the placement thereof.

Each one of the arm rests 17, see FIGS. 2–4, includes a top support element 19 of any suitable shape. In accordance with a preferred feature of the invention, however, the support element 19 is generally elliptically or parabolically bent forwardly and downwardly, as best seen in FIG. 2A. The downward bend extends from the rear or seat end of the arm rest 19 towards the front, adjacent the forward edge of the seat. The arm rest 19 is preferably made of a strong plastic material. It can be padded, or covered with decorative material, fabric, leather or the like in accordance with standard design and construction arrangements—not shown in the drawings for simplicity.

In accordance with a feature of the invention, the arm rest 19 is carried at the rear portion thereof by a length-adjustable support element 21. If the arm rest is straight, that is not bent or bowed as shown in FIG. 2, an additional straight support element 21 can be connected to the arm rest at the forward portion adjacent the front edge of the seat. As shown in FIG. 2, the arm rest 19 is coupled to a connecting link 23, preferably by a rigid connection or by a unitary shaping of the arm rest 19, the forward link connection 23 being pivotably connected at 25 to a carrier element 27 (FIG. 3) which is, in turn, securely connected to the seat structure 13 or to the support structure 11 of the chair. Similarly, the element 21 has a horizontally extending portion **21*a* which is pivotally connected at 29*a* to a cross support element 29 (FIG. 3) secured to the seat 13 or the seat support 11**.

As best seen in FIGS. 2 and 3, the arm rest 17, essentially, includes the arm rest element 19, carrier 21, and arm rest support braces 27, 29. The brace elements 27, 29 are formed with attachment holes 31, 33 (FIG. 3) to secure the arm rest 17 to the chair, for example beneath the seat or on the chair support structure. This attachment to the chair seat or the support structure is variable, as shown by the plurality of holes 31, 33, so that the spacing between the arm rests can be changed and matched to the requirements of the user. Connection of the arm rests 17 to the seat 13 is, of course, merely meant to couple the arm rests to the seat 13; the actual connection may be made for example to a housing 35 located beneath the seats 13, and surrounding the synchronization adjustment structure which controls the relative positioning of the seat and the back rest upon tilting of the seat, for example.

In accordance with a feature of the invention, the support element 21 which is positioned adjacent the seat back can be height-adjusted by an adjustment element 37 (FIG. 2). The height adjustment can be read on a scale 39 (FIG. 4). The carrier 21 is a two-part element, having an lower part 41 and a upper part 43. The upper part 43 is coupled to a plate 45 which is connected by screws 47 to the arm rest element 19. The adjustment element 37 connects the lower and upper parts 41, 43 and, essentially, includes a bolt 49 which has two oppositely directed threads thereon, for example a right-hand thread 51 and a left-hand thread 53. The threads 51, 53 are threaded into suitable tapped holes 55, 57 in the upper part 43 and the lower part 41 of the carrier, respectively. The center portion 59 of the bolt 49 is coupled to a sleeve 60, for example of plastic, which surrounds a portion of the support elements 41, 43, each. A stop, for example a spring ring 61, is fitted in a groove 63 of one of the support elements, as shown in the support element 43, in order to limit the height adjustment.

Other and equally and similarly operating elements, for example oppositely directed threads on the support elements 41, 43, respectively, with a nut extending sufficiently to cover the threads even when the elements are spaced apart, may be used. Essentially, the system operates similar to a turn buckle.

OPERATION

To adjust the height of the arm, the sleeve 60 of the adjustment element 37 is rotated, thereby pivoting the arm rest about the forward pivot 25. The rear support 21 can pivot about pivot **21*a***.

The arrangement permits adjusting the chair to fit the anatomy of the user. For example, for a given shoulder height when seated, a user with longer arms can lower the arm rests; a user with shorter arms can raise the arm rests; thus, the level of the arm rests is matched to the shoulder height of the user with respect to the seat; the spacing between the arm rests can be adjusted by, for example, loosening the support braces 27, 29 from one of the screw holes 31, 33, and repositioning the support braces for comfortable spacing laterally of the seat.

The support element 21 can be constructed differently and not formed with a pivot **21*a* but, rather, with the lower element 41 of the rear support 21 being unitary with the brace 29, slight rotary movement upon height adjustment being accomodated by torsion or by forming holes 33** in slightly oval shape.

Various changes and modifications may be made within the scope of the inventive concept.

I claim:

1. Arm chair, particularly office arm chair comprising a seat (13);

a chair back located at a rearward portion of the seat;

and arm rests (17) located laterally of the seat at a position which is elevated with respect to the seat, said arm rests extending, from a position adjacent the chair back, downwardly towards the front portion of the seat;

pivotable coupling means (25) pivotably connecting respective forward portions of the arm rests to the front portion of the seat, wherein said pivotable coupling means comprises a brace element (27) secured to the seat, and a pivot connection (25) between the arm rest and said brace element, the position of said brace element laterally with respect to the seat being adjustable;

support means (21) coupling the arm rests to the seat positioned in the vicinity of the back rest (15) or the rearward portion of the seat, the position of the support means laterally with respect to the seat being adjustable, wherein the support means comprises a pair of elongated support rod elements, one rod element having a right-handed thread (51) formed thereon and the other rod element having a left-hand thread (53) formed thereon, and a positioning element (37) having, respectively, right and left-hand threads for engagement with the right and left-hand thread of the support rod elements and for, respectively, separating or approaching the support rod elements to thereby adjust the effective length of said support means; and pivot means (21*a;* 33) for connecting said support means (21) to a rearward portion of the seat while permitting deflection of the support means towards and away from the chair back, and wherein said support means (21) are length-adjustable so that the elevational distance between the arm rests and the seat can be adjustably determined.

2. The chair of claim 1, wherein said positioning element (37) comprises a sleeve (60) and means (49, 59) coupling the sleeve to said right-hand and left-hand threads, and carrying right-hand and left-hand threads for, effectively, adjusting the length of said elongated support rod elements and hence of said support means upon rotation of the sleeve.

3. The chair of claim 2, further including a stop means (61) within the sleeve to limit the relative longitudinal position of the sleeve with respect to the elongated support rod elements upon rotation of the sleeve.

4. The chair of claim 3, further including a positioning scale (39) located on at least one of said elongated support rod elements to permit reading of an adjusted position reflecting the effective length of said support means.

5. The chair of claim 1, wherein the arm rest includes an arm support portion (19) and a forward, downwardly bent region, said forward, downwardly bent region being coupled to the forward portion of the seat by said pivotable coupling means (25).

6. The chair of claim 1, wherein said support means (21) extends essentially vertically between the seat (13) and the arm rest (17).

* * * * *